US006149464A

United States Patent [19]

DeBauche et al.

[11] Patent Number: 6,149,464

[45] Date of Patent: Nov. 21, 2000

[54] APPARATUS FOR DETECTING CABLE ATTACHMENT

[75] Inventors: Bradley James DeBauche, Delray Beach; Paritosh Dinubhai Patel, Deerfield Beach; Steve Harris Weingart, Boca Raton, all of Fla.

[73] Assignee: International Business Machines Corporation, Armonk, N.Y.

[21] Appl. No.: 09/371,432

[22] Filed: Aug. 10, 1999

Related U.S. Application Data

[62] Division of application No. 08/373,339, Jan. 17, 1995, abandoned.

[51] Int. Cl.[7] ..... H01R 13/648

[52] U.S. Cl. ..... 439/609; 439/108; 439/489

[58] Field of Search ..... 439/488, 489, 439/490, 607, 609

[56] References Cited

U.S. PATENT DOCUMENTS

| | | | |
|---|---|---|---|
| 5,067,914 | 11/1991 | Seidel et al. | 439/607 |
| 5,228,871 | 7/1993 | Goodman | 439/607 |
| 5,236,375 | 8/1993 | Kachlic | 439/607 |
| 5,397,246 | 3/1995 | Defibaugh et al. | 439/607 |
| 5,584,718 | 12/1996 | Sukegawa | 439/607 |
| 5,674,085 | 10/1997 | Davis et al. | 439/607 |

*Primary Examiner*—Hien Vu

*Attorney, Agent, or Firm*—Ronald V. Davidge; Richard A. Tomlin

[57] ABSTRACT

A port connector of a computing system is provided with a flexible electrical contact for determining the presence of the electrically grounded flange of a cable connector which may be attached to the port connector. Using this feature, the computing system can determine whether a peripheral device is attached to the port connector by means of a cable.

14 Claims, 4 Drawing Sheets

APPARATUS FOR DETECTING CABLE ATTACHMENT

This is a division of application Ser. No. 08/373,339, filed Jan. 17, 1995 now abandoned.

BACKGROUND OF THE INVENTION

1. Field of the Invention

This invention relates to detecting of the attachment of a peripheral device to a computing system, and more particularly, to detecting the attachment of a conventional cable connector to a port connector of the system.

2. Background Information

Personal computer systems generally include a system unit connected to a number of peripheral devices by means of cables extending from the peripheral devices to be connected to port connectors on the system unit. A number of types of connectors have been developed and standardized, with specific connector-types being used for connection to specific types of devices, such as keyboards, parallel devices such as printers, serial devices, video monitors, and devices using the SCSI (Small Computer Serial Interface) interface. These connector types generally include a number of mating contact terminals extending into engagement with one another through openings in mating conductive shields of the connectors. A shield of this type includes a flange extending around the opening, toward the opposite mating connector, so that the flanges of mating connectors move inside one another, in sliding contact, as the connectors are engaged. These mating shields typically form part of a conductive shielding arrangement surrounding the system unit, the peripheral device, and the interconnecting cable. This conductive shielding arrangement prevents the radiation, from the computer system, of certain electromagnetic signals which could otherwise result in EMI (electromagnetic interference) with communication signals.

The use of portable and mobile computing equipment has created an increasing need to change the configuration of a computing system on a frequent basis. For example, a laptop computer may be disconnected from various peripheral devices in an office, taken home for use at night, and reconnected to the office peripheral devices in the morning. Such an increased need to unplug and replug cable connectors leads to an increased probability that some cables will inadvertently be left unplugged. What is needed is a simple way of detecting whether a cable is connected, so that this information can be transferred to application programs and to the user as appropriate.

One method which has been used to detect the attachment of various types of peripheral devices is the sensing of various jumper configurations in a the connector of the peripheral device. For example, if three contact positions—A, B, and C—extending between the port connector and the device connector are used for this purpose, five combinations can be detected—no jumpers, a single jumper between contact positions A and B, a single jumper between contact positions B and C, a single jumper between contact positions A and C, and jumpers connecting A, B, and C. The condition of no jumpers also exists when no cable is plugged onto the device connector. This method is used at the connection between the video port of a personal computer and the cable to a video display device, in order to discriminate among several different types of display devices, requiring different driving signals, which may be alternately connected to the video port. However, since this method requires the use of additional contact positions in both the port connector and the connector of the cable to the device, it can only be used in applications where such contact positions have been provided.

A typical computer user has a need to use a number of existing peripheral devices when a new system unit is added. For this reason, it is particularly desirable to make a system unit having new features compatible with formerly manufactured versions of peripheral devices. Furthermore, it is undesirable to proliferate required configurational differences throughout both system units and peripheral devices. For example, any method providing for detection of the attachment of a peripheral device should function properly with existing, unmodified versions of the peripheral device. What is needed is a method, which may be applied to a system unit or other type of unit to which a peripheral device is attached, for detecting the attachment of the peripheral device, without requiring changes to the circuits of the peripheral device or to the connector of the cable extending from this peripheral device. In particular, additional contact positions in this connector should not be required to provide the attachment detection function.

3. Description of the Prior Art

A number of U.S. patents describe connector apparatus which use the closure of a switch within a first connector, attached to the device in which the feature is provided. The switch is closed by a feature within a second connector, mating with the first connector. An extra pair of wires, from the device in which the feature is provided, are attached to the opposite sides of the switch.

For example, U.S. Pat. No. 5,061,204 to Murakami describes a prior art system in which a flexible metal contact is held against a stationary contact in the first connector by a flexible insulating member extending within the second connector. Wires extend from the flexible and stationary contact to provide the electrical indication needed for this feature. If the two connectors are not engaged, the flexible metal contact is held, by its own shape, away from the stationary contact; if the two connectors are not completely engaged, the flexible insulating member is held away from the flexible metal contact by an interposing structure of the first connector.

Murikami teaches a connector arrangement having a movable part, slidably mounted to move in a longitudinal direction within the first connector. A conductive path extends along each side of the movable part in electrical contact with an adjacent electrical terminal of the connector. The first connector also includes a flexible insulating latch. As the two connectors are slid into engagement, an edge of the second conductor slides the movable part within the first connector toward a tip of the latch, while an interposing structure of the second connector deflects the latch away from the movable part. When the connectors are fully engaged, the latch clears the interposing structure, to rotate upward into engagement with the movable part. A conductive path extending along the tip of the latch forms an electrical connection between the conductive paths extending along the opposite sides of the movable part.

Additional connector arrangements of this general type are described in U.S. Pat. No. 5,131,865 to Taguchi, et al.

U.S. Pat. No. 4,915,649 to Shimazu, et al., describes a first connector having a contact piece, with a base portion and bifurcated free ends, held in place adjacent to a pair of contact terminals. One of the free ends is held in contact with one of the contact terminals, and the other of the free ends is moved into contact with the other contact terminal by an arm extending from the second connector when the two connectors are fully engaged.

A limitation of these methods arises from the fact that, in each case, a specialized feature of the second connector is required to effect the switch closure. The prior art described by Murakami requires a flexible member extending in the second connector to close the contacts. The connector system taught by Murakami requires an interposing structure of the second connector to deflect the flexible member of the first connector, along with a contact terminal arrangement providing space for the movable member and for a contact terminal on each side of the movable member for use with the detection feature. The system described by Shimazu, et al., requires an arm extending from the second connector to close the contacts. The need for such features means that this method cannot be readily used in a system requiring the detection, for example, of the attachment of cabled peripheral devices not configured in anticipation of providing for such detection, since the second connector is the one forming part of the cable assembly extending from such a peripheral device.

Another method for providing the detection feature includes provisions for an additional contact pair within the first and second connectors. In this way, an additional electrical path is provided, so that a ground, voltage condition, or other signal from a peripheral device or cable can be returned to activate the detection feature.

This method is described, for example, in U.S. Pat. No. 3,611,261 to Gregory. In this example, one of the connectors has a barbed resilient limb, while the other connector has an apertured lug. Electrical contact surfaces extend adjacent to the barb and the aperture. As the connectors are moved into engagement, these contact surfaces are moved apart by interposition of the barb. When these connectors are fully engaged, the barb extends into the aperture, with the contact surfaces held together to complete the detection circuit.

U.S. Pat. No. 3,414,806 to Carr describes a version of this method in which the pin used for detecting contact engagement is provided with a resistive portion. When the connectors are partly engaged, contact is made with the resistive portion; when the connectors are fully engaged, contact is made with a conductive portion of the pin.

Another example of this method is described by Klim, et al., in the *IBM Technical Disclosure Bulletin,* June, 1993, Vol. 30, No. 6, p. 371. In this example, a pluggable unit, such as a keyboard or a mouse, is plugged into a system unit by a cable having a connector. Electrical ground is carried to the pluggable unit from the system unit by conventional means, and a ground return line is added to the cable and connectors to return an electrical ground condition from the pluggable device to the system unit. Within the system unit, the contact engaging the ground return line is connected to a detection circuit and to a positive voltage through a pull-up resistor. When the pluggable unit is disconnected, the input to the detection circuit is held at the high level of the positive voltage; when the pluggable unit is connected, the input to the detection circuit is held at electrical ground.

These methods also have the disadvantage of requiring specialized features of the second connector. An additional connection terminal, together with associated wiring, is required. What is needed is a method allowing detection of the attachment of standard, widely-used connector types not having such features. Such a method is needed both to allow the detection of the attachment of conventional peripheral devices with standard connectors and to reduce the additional costs incurred through the use of specialized connectors.

U.S. Pat. No. 4,903,340 to Sorensen describes the use of a magnetically activated reed switch to detect the physical closure of an optical data link extending through a pair of connectors. Again, this method requires the presence of a specialized feature, in the form of a permanent magnet, as a part of the second connector.

SUMMARY OF THE INVENTION

In accordance with one aspect of the invention, there is provided a connector including a number of contact terminals extending in a first direction within a contact region, an electrically conductive flange extending around the contact region, a contact spring extending adjacent to the flange contact surface, and an insulating structure holding the contact terminals, the flange, and the contact spring. The flange contact surface also extends in the first direction. In other words, the flange contact surface lies parallel to the contact terminals while extending around the contact terminals.

BRIEF DESCRIPTION OF THE DRAWINGS

Preferred embodiments of the subject invention are hereafter described with specific reference being made to the following Figures, in which.

DETAILED DESCRIPTION

Figure 1:
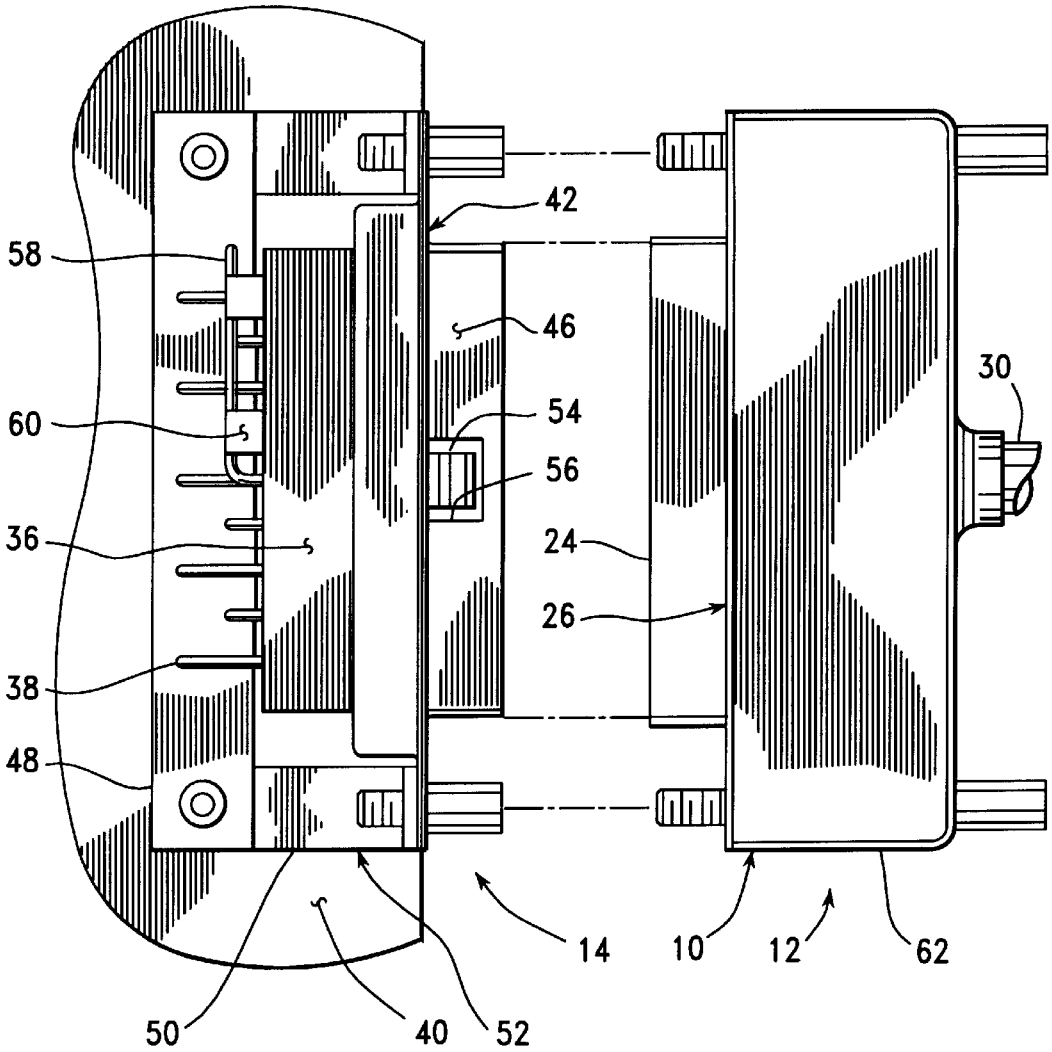
FIG. 1 is a plan view of a connector built in accordance with a first embodiment of this invention, in an exploded relationship with a first type of conventional connector at an end of a cable.
Figure 2:
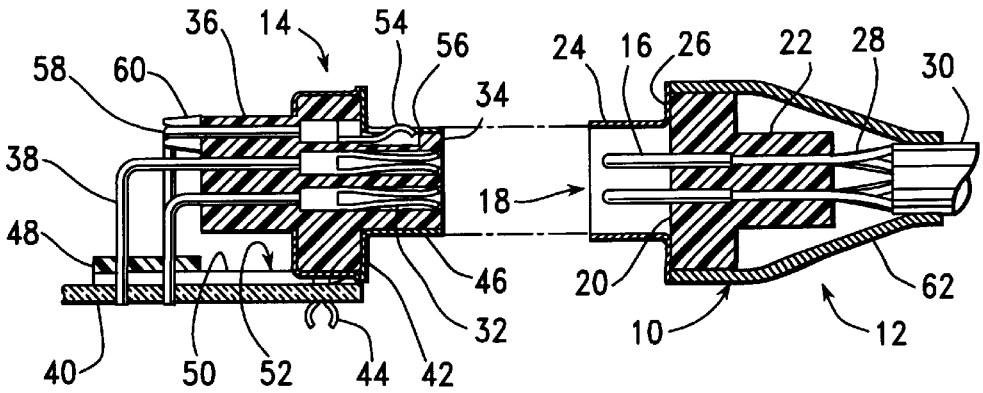
FIG. 2 is a longitudinal sectional view of the apparatus of FIG. 1.

FIGS. 1 and 2 show a first embodiment of the subject invention. FIG. 1 is a plan view, and FIG. 2 is a longitudinal sectional view, of a conventional connector 10, forming part of a conventional cable assembly 12, in an exploded relationship with a port connector 14, having particular improvements required to provide for detection of the attachment of cable assembly 12 thereto.

Referring to FIGS. 1 and 2, cable connector 10 includes a number of contact terminals in the form of pins 16, extending within a cavity 18 formed by a face 20 of insulating block 22 and a by flange 24 extending as part of a conductive shell 26. This flange 24 extends completely around the pins 16. Pins 24 are individually connected to a number of wires 28 extending through an insulated sleeve 30 to, for example, a peripheral device (not shown).

Port connector 14 includes a number of contact terminals in the form of contact springs 32 held within an extending portion 34 of an insulating block 36. Each contact spring 32 is connected to a soldertail 38 extending downward. Port connector 14 is attached to a circuit card 40 as the individual soldertails 38 are soldered in place within plated through holes in the circuit card. Circuit traces (not shown) within circuit card 40 individually direct signals and voltage levels to various of the soldertails 38. A conductive shell 42 is typically connected to electrical ground by various means, such as by soldering tabs 44, extending downward as parts of the shell 42, to electrically grounded conductive surfaces of circuit card 40. A flange 46 extends around extending portion 34 of insulating block 36 as a part of conductive shell 42. Soldertails 38 are held in place before assembly to circuit card 40 by means of an insulating strip 48 extending between tabs 50 of a bracket 52.

Cable connector 10 is engaged with port connector 14 as flange 24 is slid over flange 46. When these flanges 24 and 46 are aligned in this way, pins 16, are individually aligned with spring contacts 32, so that pushing the connectors 12 and 14 together establishes a number of conductive paths between soldertails 38 and wires 28, with each pin 16 extending into a spring contact 32, to be engaged mechanically by deflecting the spring contact. To make this type of engagement possible, the surfaces of flange 46 extend in the same direction as spring contacts 32. Since shell 42 is connected to electrical ground, the sliding engagement of flange 46 with flange 24 forms an electrical connection of shell 26 to ground. In some applications, shell 26 may be grounded by other or additional means, such as electrical attachment to a ground line extending from one of the pins 16 or electrical attachment to a grounded chassis of a peripheral device (not shown) at the opposite end of cable 12.

The attachment of cable connector 10 to port connector 14 is detected through the use of a cantilever contact spring 54 held in place within insulating block 36 to extend through an aperture 56 in flange 46 without touching flange 46. Contact spring 54 is fastened to a soldertail 58 held in place by support tabs 60 extending as portions of insulating block 36. In this configuration, soldertail 58 extends downward through holes in insulating strip 48 and in circuit card 40, at an end position in a row of holes established for soldertails 38. When cable connector 10 is not connected to port connector 14, contact spring 54 is in an open circuit condition. When cable connector 10 is connected to port connector 14, contact spring 54 is held against the inner surface of flange 24, which is connected to electrical ground as described above.

The sliding, mating engagement occurring between flanges 24 and 46, as the connectors 10 and 14 are brought together, surrounds the individual circuits formed by the connection of pins 16 with contact springs 32 with an electrically conductive cover. In this way, a grounded conductive shield if formed around these circuits. This effect can be extended along cable 12 through the use of a conductive connector cover 62 and through the use of a flexible conductive covering (not shown) over wires 28 within insulating sleeve 30. This effect can also be extended using grounded conductive covers (not shown) over circuits within the device of which port connector 14 is a part, and over the peripheral device (not shown) attached to cable 12. This type of shielding is known to be particularly effective in reducing electromechanical interference (EMI) radiated from the system consisting of these devices, and, in some cases, in reducing the susceptibility of the circuits within this system to EMI from other sources.

The aperture 56, through which cantilever spring contact 54 extends to contact an interior surface of flange 24, is preferably surrounded by conductive portions of shell 42, so that electrical currents flowing along shell 42 can easily flow around aperture 56. Furthermore, aperture 56 is preferably small in size and is mostly covered by flange 24 when the connectors 10 and 24 are fully engaged. For these reasons, the provisions made for cantilever spring contact 54 have at most a minimal effect on maintaining the effective shielding of the pair of connectors 10 and 14.

The similar application of the present invention to an alternative form of connectors will now be discussed, with particular references being made to FIG. 3, a longitudinal view of an alternate port connector 70 built in accordance with a second embodiment of the invention, in an exploded relationship with a standard connector 72 forming part of a conventional cable assembly 74. As before, the cable connector may be an entirely conventional device, while particular elements are added to the port connector to provide the means to detect cable connection.

Figure 3:
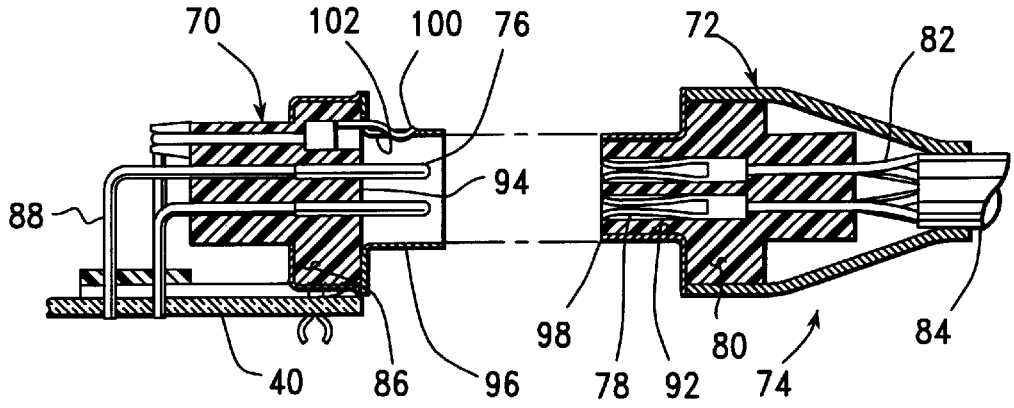
FIG. 3 is a plan view of a connector built in accordance with a second embodiment of this invention, in an exploded relationship with a second type of conventional connector at an end of a cable.

Referring to FIG. 3, in this second embodiment, port connector 70 includes a number of terminals formed by contact pins 76, while cable connector 72, at one end of a cable assembly 74, includes a number of contact terminals formed by spring contacts 78. These spring terminals 78, extending within an insulating block 80, are electrically connected to a number of wires 82 extending through the cable assembly 75 within a insulating sleeve 84. In port connector 70, contact pins 76, within an insulating block 86, are connected to soldertails 88, which are in turn connected by solder to circuit traces of circuit card 40. When the connectors 72 and 70 are fully engaged, an outward-extending portion 92 of cable connector 72 extends into a cavity formed by a front face 94 of insulating block 86 and by flange 96 of a conductive shell 98. This outward-extending portion 92 is surrounded by a conductive flange 98. Flange 96 is electrically grounded through the circuit card 40, or through adjacent structures, and flange 98 becomes grounded through contact with flange 96 if it is not already grounded by other means.

The attachment of cable assembly 74 to port connector 70 is detected through the use of a cantilever spring 100 extending inward through an aperture 102 in flange 96 to contact an outer surface of flange 98. When this cable connection is not made, cantilever spring 100 is electrically floating; when this connection is made, the spring 100 is electrically grounded.

Figure 4:
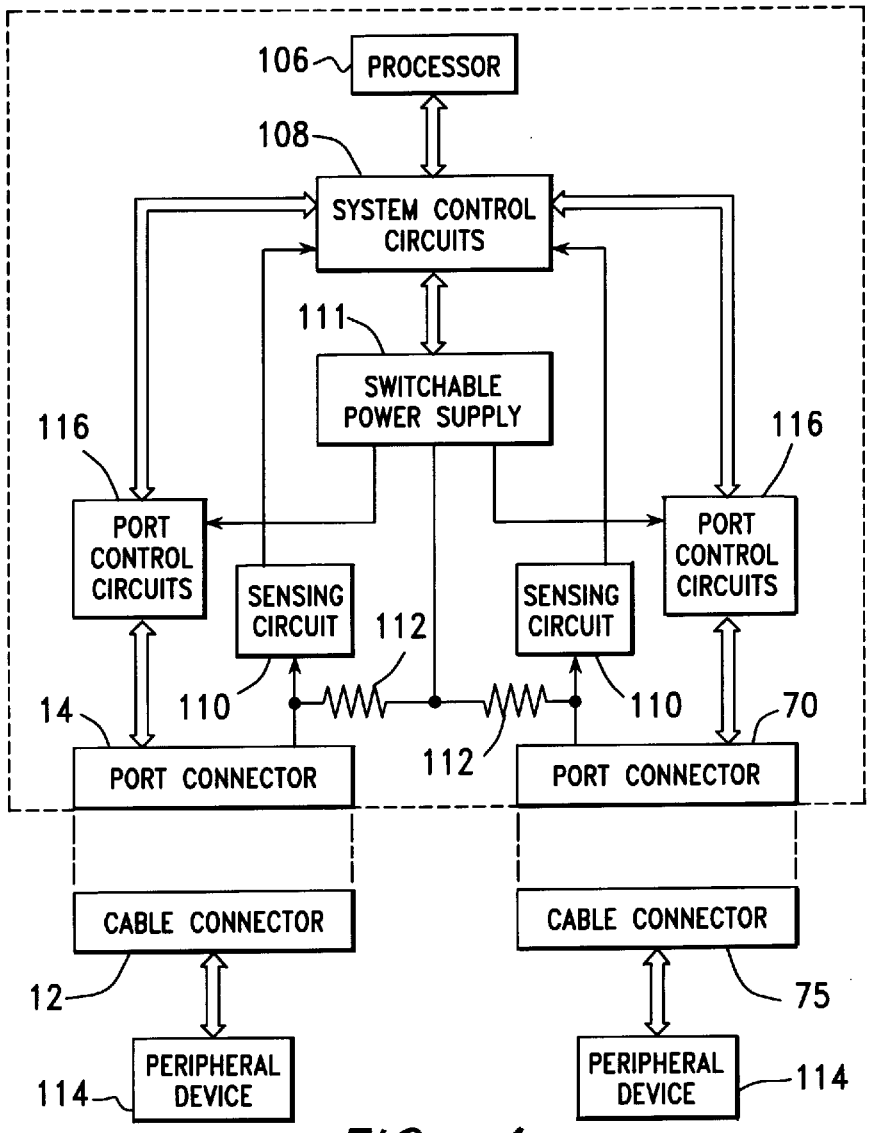
FIG. 4 is a schematic diagram of a system built in accordance with the subject invention to detect individual attachments to port connectors, using the connectors of FIGS. 1 and 2.

FIG. 4 is a schematic diagram of a computing system 104, having a processor 106 and associated system control circuits 108, built in accordance with the subject invention to detect the attachment of individual cables to individual port connectors. The computing system 104 includes, for example, one port connectors 14, of the type previously discussed in reference to FIGS. 1 and 2, and one port connectors 70, of the type previously discussed with reference to FIG. 3. Each cantilever spring 42 or 100 (shown in FIGS. 2 and 3, respectively) is electrically connected to an input of sensing circuit 110, and to an output voltage of a power supply 111 through a pull-up resistor 112. If a mating cable assembly 12 is not connected to a port connector 14, the cantilever spring 42 (shown in FIG. 2) of the port connector 14 floats electrically, so that the voltage output of power supply 111 is placed at the input of the associated sensing circuit 110 through an associated pull-up resistor 112. On the other hand, when the mating cable 12 is connected to the port connector 14, the cantilever spring 42 brings the input of the associated sensing circuit 110 to ground level. Thus, to detect the presence of a cable, sensing circuit 110 needs only to be able to differentiate between ground potential and this voltage output level of power supply 111. A number of well-known methods can be used to detect a difference of this kind. The output of each sensing circuit 110 is provided as a separate input to system control circuits 108. When a cable assembly 75 is connected to, or disconnected from, a port connector 70, the associated cantilever spring 100 (shown in FIG. 3) controls the input to a sensing circuit 110 in a similar manner.

While two port connectors are shown in FIG. 4 for illustrative purposes, the present invention may be applied to a single port connector or to a relatively large number of port connectors. While these port connectors 14 and 70 are described as being of only two different types, if the ports associated with these connectors have different electrical characteristics or functions, the connectors may also have different keying arrangements or pin arrangements to help ensure that only the appropriate cable is plugged into each port connector. In general, the present invention may be applied to detect the attachment of various types of connectors having a conductive grounding shell, such as connectors conventionally used for parallel ports, for 9-pin and 25-pin serial ports, for SCSI (Small Computer Serial Interface) ports, for keyboard attachment, and for video monitor attachment. If sufficient differentiation of this kind is provided among the various port connectors 14 and 70, along with their mating cable assemblies 12 and 75, it is possible to determine which types of peripheral devices 114 are connected to a system having a number of ports by examining the outputs of sensing circuits 110.

Power supply 111 is preferably provided with a capability to switch various of its outputs from an "on" condition to an "off" condition. This capability, together with the ability of the computing system 104 to recognize which, if any, of its ports are connected to peripheral devices 114, is used to enhance the power management capabilities of the system by turning off electrical power to individual port control circuits 116 associated with ports not connected to peripheral devices 114. This capability is particularly useful if the system 104 is a portable, battery-operated device, in which the length of time between battery charging operations may be extended by reducing operating power. This feature is also useful in increasing reliability by reducing the power-on hours of certain components.

FIGS. 5–8 are block diagrams showing portions of routines which are preferably executed in processor 106 (shown in FIG. 4) to take particular advantage of the ability provided, as described above in reference to FIGS. 1–4, to determine which peripheral devices, if any, are connected to the system. The various processes described in reference to FIGS. 5–8 are parts of different programs or subroutines. Any combination of these processes may be applied to a single processor 106.

Figure 5:
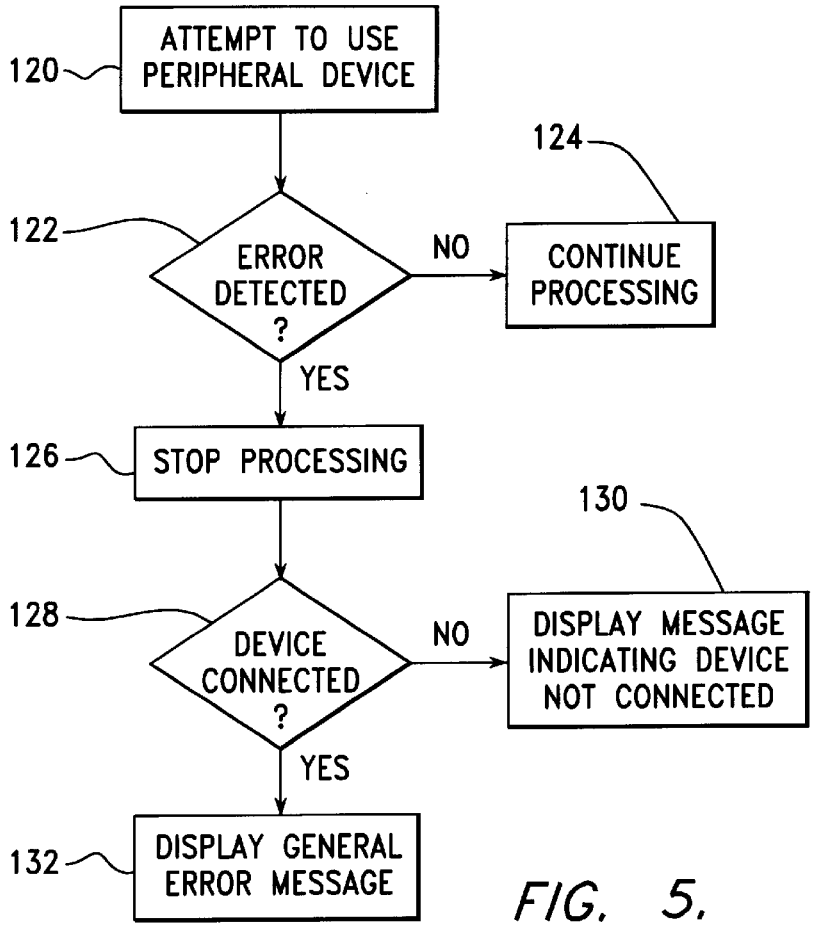
FIG. 5 is a partial block diagram of a routine executing in the processor of the system of FIG. 4, using the ability to detect attachment to port connectors to display a particular error message.

Referring first to FIG. 5, in a portion of a routine executing in processor 106, the ability to recognize that a particular cable is disconnected may also be used to display a more meaningful error message, such as "printer not connected," on the display screen of the computing system 104, whenever an attempt is made use a peripheral device which is not connected to the system. In step 120, an attempt is made to use the peripheral device. If an error is not detected in step 122, processing is continued, using the device, in step 124. If an error is detected in step 122, normal processing is stopped in step 126, and a determination is made in step 128 of whether the device is connected. If it is not connected, an error message indicating disconnection is displayed in step 130. If it is connected, a more general error message is displayed in step 132. This capability is again particularly useful in a portable system, which may typically be used as part of a system including a number of peripheral devices within an office environment and as a stand-alone device elsewhere. Since cables are often connected and disconnected from such a system, the likelihood that a cable will be inadvertently left disconnected during the use of a system is greatly increased.

Figure 6:
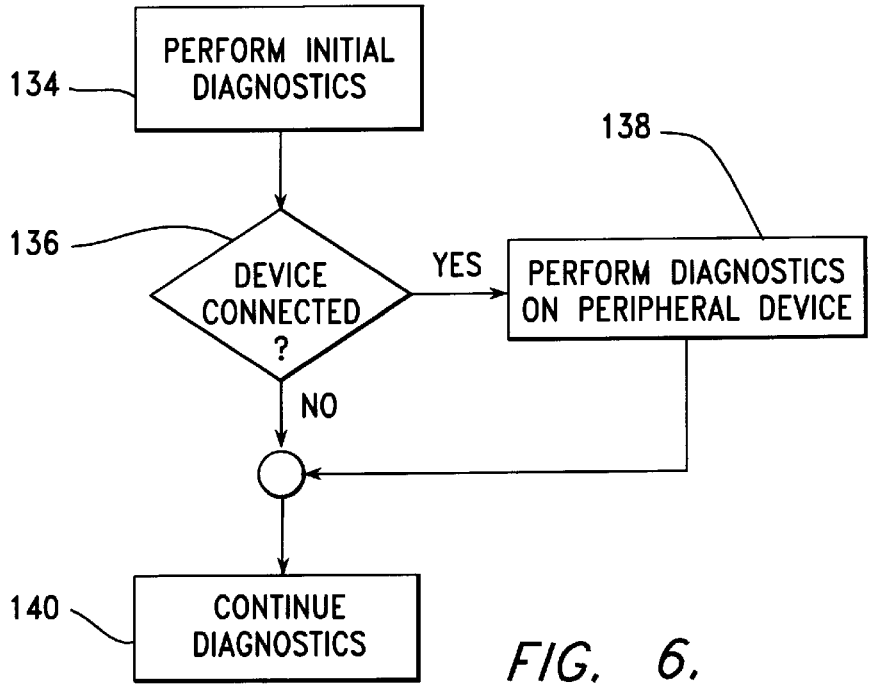
FIG. 6 is a partial block diagram of a routine executing in the processor of the system of FIG. 4, using the ability to detect attachment to port connectors to perform diagnostics in an optional peripheral device.

Referring to FIG. 6, in another routine executing in processor 106, the ability to detect cable attachment is used to determine whether diagnostic procedures are to be applied to the peripheral device. After general diagnostics are performed in step 134, a determination is made in step 136 of whether the peripheral device is connected. If it is connected, diagnostics are performed on the peripheral device in step 138. In either case, the general diagnostic procedure is continued in step 140.

Figure 7:
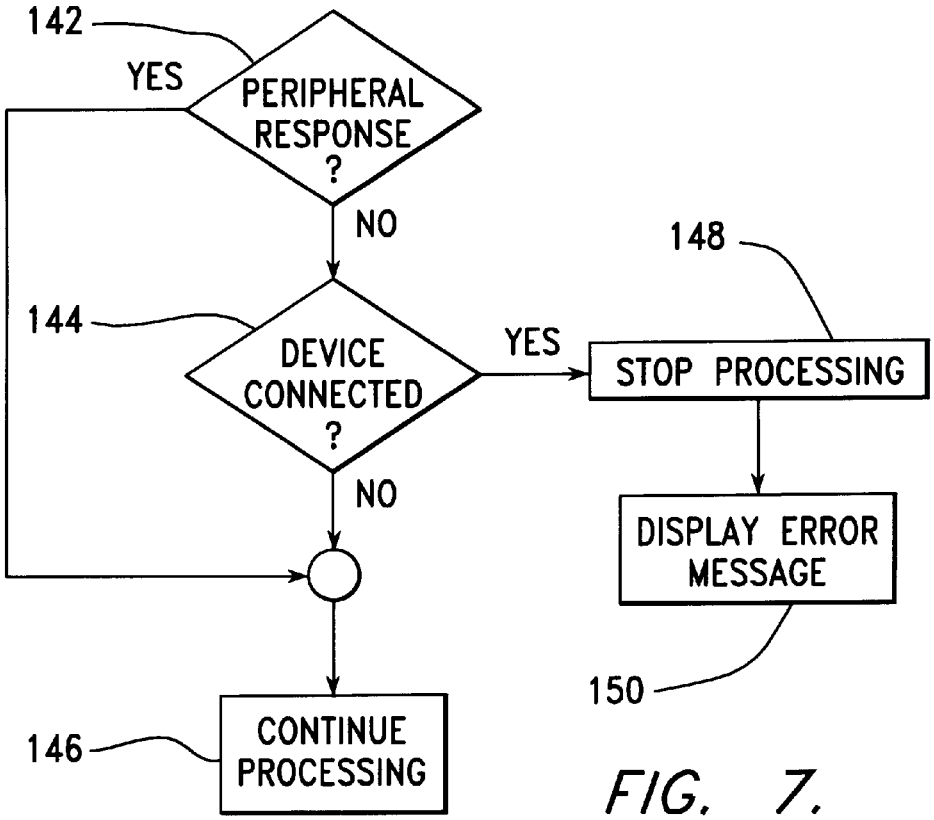
FIG. 7 is a partial block diagram of a routine executing in the processor of the system of FIG. 4, using the ability to detect attachment to port connectors to determine whether a response from a peripheral device is required.

Referring to FIG. 7, in another routine executing in processor 106, the ability to detect cable attachment is used to determine whether a response from a peripheral device should be required. If the peripheral response is expected, but is not received, as determined in step 142, a further determination is made in step 144 of whether the peripheral device is connected. If the device is not connected, processing continues in step 146. If the device is connected, a legitimate error has been detected, so normal processing is stopped in block 148, and an error message is displayed in block 150. An example of this embodiment is found in a tablet, or pen, computer to which a peripheral keyboard device may be attached. The keyboard device, which is otherwise a required part of a desktop computing system, generates a signal indicating that a self test routine has been completed. If this signal is not received by the tablet computer to which the keyboard is not attached, as determined in step 144, processing continues under the implied assumption that another device, such as a digitizer tablet, will be used to provide inputs to the system. If this signal is not received when expected in a system to which the keyboard is attached, normal processing is stopped, while an error message indicating a keyboard problem is displayed.

Figure 8:
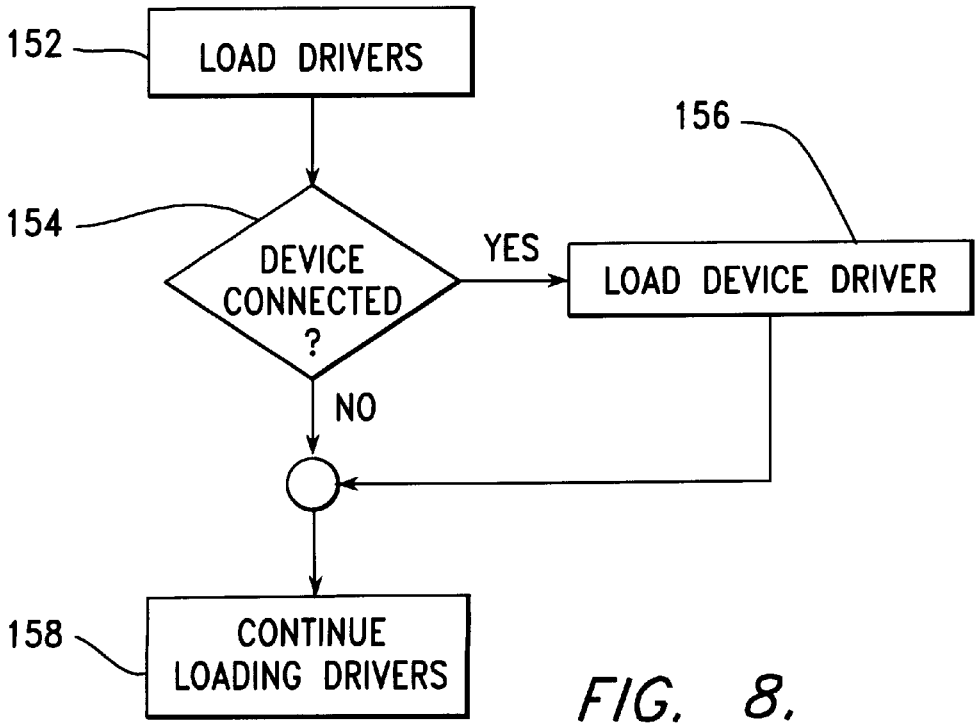
FIG. 8 is a partial block diagram of a routine executing in the processor of the system of FIG. 4, using the ability to detect attachment to port connectors to determine whether a device driver is loaded for an optional peripheral device.

Referring to FIG. 8, in another routine executing in processor 106, the ability to detect cable attachment is used to provide for the selective enabling of certain peripheral device functions. After various device drivers are loaded in step 152, a determination is made in step 154 of whether the peripheral device is connected. If it is, the driver for the peripheral device is loaded in step 156. In either case, the process of loading device drivers continues in step 158. In this way, device drivers and applications can be loaded to configure the system as a function of the connected peripheral devices, with software being loaded only to activate the available hardware.

The connector configurations described in reference to FIGS. 1–3 have, when compared to prior art connector configurations, the significant advantage of providing the connection detection function when a purely convention cable connector is attached. Thus, a system having the connection detection function can be used with conventional peripheral devices. The same peripheral device can be fully functional with systems having the feature and with systems without the feature, which provides specific advantage for the system as described in reference to FIGS. 4–8.

While the invention has been described in its preferred forms or embodiments with some degree of particularity, it is understood that this description has been given only by way of example and that numerous changes in the details of construction, fabrication and use, including the combination and arrangement of parts, may be made without departing from the spirit and scope of the invention.

What is claimed is:

1. A connector comprising:

a plurality of contact terminals extending in a first direction within a contact region;

an electrically conductive flange extending around said contact region, said flange including a flange contact surface extending in said first direction, and an aperture extending through said contact surface;

a contact spring extending adjacent said flange contact surface, wherein said contact spring extends through said aperture, beyond said flange contact surface;

an insulating structure extending from said flange holding said contact terminals and said contact spring;

a plurality of terminal soldertails extending through said insulating structure, with each terminal soldertail within said plurality of terminal soldertails being fastened to a contact terminal at a first end of said terminal soldertail, and with a second end of each said terminal soldertail, opposite said first end of said terminal soldertail, extending in a second direction for attachment to a circuit card; and a contact spring soldertail extending through said insulating structure, with said contact spring soldertail being fastened to said contact spring at a first end of said contact spring soldertail, and with a second end of said contact spring soldertail extending in said second direction for attachment to said circuit card.

2. The connector of claim 1:

wherein a portion of said insulating structure extends within said flange;

wherein said flange contact surface forms an outer surface of said flange; and wherein said contact spring extends outward through said aperture.

3. The connector of claim 2, wherein each contact terminal within said plurality of contact terminals includes a flexible spring terminal extending within said portion of said insulating structure.

4. The connector of claim 1:

wherein said flange extends around a cavity:

wherein said flange contact surface forms an inner surface of said flange; and wherein said contact spring extends inward through said aperture, into said cavity.

5. The connector of claim 4, wherein each contact terminal within said plurality of contact terminals includes a pin extending in said first direction within said cavity.

6. Apparatus comprising:

a port connector having a plurality of port connector terminals extending within a port connector contact region, an electrically conductive and electrically grounded port connector flange extending around said port connector contact region, wherein said port connector flange includes an aperture, and a connection-sensing contact extending adjacent said port connector flange, wherein said connection-sensing contact extends through said aperture and beyond said port connector flange;

a cable connector having a plurality of cable connector terminals extending within a cable connector contact region, and an electrically conductive cable connector flange extending around said cable connector contact region, wherein, as said cable connector is brought into engagement with said port connector, said cable connector terminals individually contact said port connector terminals, and said cable connector flange contacts both said port connector flange and said connection-sensing contact; and a sensing circuit electrically connected to said connection-sensing contact, wherein said sensing circuit produces an output signal in response to a determination that said connection-sensing contact is electrically grounded.

7. The apparatus of claim 6:

wherein said port connector flange slides within said cable connector flange as said cable connector is engaged with said port connector; and wherein said connection-sensing contact extends outward through said aperture.

8. The apparatus of claim 6:

wherein said cable connector flange slides within said port connector flange as said cable connector is engaged with said port connector; and wherein said connection-sensing contact extends inward through said aperture.

9. The apparatus of claim 6, wherein said connection-sensing contact is additionally electrically connected to a voltage level through a resistor, and said sensing circuit differentiates between said voltage level and electrical ground to determine whether said connection-sensing contact is electrically grounded.

10. Apparatus for forming a plurality of electrical connections, wherein said apparatus comprises:

a first connector having a first plurality of contact terminals around which a first conductive shield extends;

a second connector engaging said first connector, wherein said second connector has a second plurality of contact terminals mating said first plurality of contact terminals, a connection-sensing contact engaging said first conductive shield, and an electrically grounded second conductive shield engaging said first conductive shield, wherein said connection-sensing contact and said second conductive shield are electrically connected through said first conductive shield, wherein said first conductive shield fits around and over said second conductive shield; wherein said second conductive shield includes an aperture; and wherein said connection-sensing contact extends outward through said aperture and beyond said aperture to contact said first conductive shield; and a sensing circuit electrically connected to said connection-sensing contact, wherein said sensing circuit produces an output signal in response to a determination that said connection-sensing contact is electrically grounded.

11. The apparatus of claim 10:

wherein each contact terminal within said second plurality thereof includes a receptacle extending within an insulating block, with said insulating block extending within said second conductive shield; and wherein each contact terminal within said first plurality thereof includes a pin extending within said receptacle of a contact terminal within said second plurality thereof.

12. The apparatus of claim 10:

wherein said second conductive shield fits around and over said first conductive shield;

wherein said second conductive shield includes an aperture; and wherein said connection-sensing contact extends inward through said aperture to contact said first conductive shield.

13. The apparatus of claim 12:

wherein each contact terminal within said first plurality thereof includes a receptacle extending within an insulating block, with said insulating block extending within said first conductive shield, and wherein each contact terminal within said second plurality thereof includes a pin extending within said receptacle of a contact terminal within said first plurality thereof.

14. The apparatus of claim 10, wherein said connection-sensing contact is additionally electrically connected to a voltage level through a resistor, and said sensing circuit differentiates between said voltage level and electrical ground to determine whether said connection-sensing contact is electrically grounded.

* * * * *